US006715408B1

(12) United States Patent
Rossi

(10) Patent No.: US 6,715,408 B1
(45) Date of Patent: Apr. 6, 2004

(54) TENSIONING DEVICE FOR TRAPPING MACHINES

(75) Inventor: Gian Luigi Rossi, Meina (IT)

(73) Assignee: MACPRO S.a.s. di Alberto Galli & C., Arona (IT)

( * ) Notice: Subject to any disclaimer, the term of this patent is extended or adjusted under 35 U.S.C. 154(b) by 0 days.

(21) Appl. No.: 10/130,984

(22) PCT Filed: Nov. 22, 2000

(86) PCT No.: PCT/IB00/01721

§ 371 (c)(1),
(2), (4) Date: May 24, 2002

(87) PCT Pub. No.: WO01/38175

PCT Pub. Date: May 31, 2001

(30) Foreign Application Priority Data

Nov. 25, 1999 (IT) ..... MI99A2461

(51) Int. Cl.[7] ..... B65B 13/22; B65B 13/24
(52) U.S. Cl. ..... 100/32; 100/29; 53/589
(58) Field of Search ..... 100/33 R, 32, 100/29, 26, 8; 53/589, 590, 591, 399

(56) References Cited

U.S. PATENT DOCUMENTS 4,409,058 A * 10/1983 Suwabe et al. ..... 156/561
4,559,767 A * 12/1985 Takami ..... 53/589
4,569,186 A * 2/1986 Mori et al. ..... 53/589
4,635,541 A * 1/1987 Kasuga ..... 100/2
4,912,908 A * 4/1990 Sakaki ..... 53/589
4,955,180 A * 9/1990 Sakaki et al. ..... 53/399
5,083,412 A * 1/1992 Sakaki et al. ..... 53/399
5,377,477 A * 1/1995 Haberstroh et al. ..... 53/399
5,379,576 A 1/1995 Koyama

FOREIGN PATENT DOCUMENTS

| | | |
|---|---|---|
| DE | 33 00 439 A1 | 7/1983 |
| EP | 0 076 357 | 4/1983 |
| EP | 0 144 508 | 6/1985 |
| EP | 0 603 868 | 6/1994 |
| GB | 2 205 807 A | 12/1988 |
| IT | 1135722 | 3/1981 |

* cited by examiner

*Primary Examiner*—Allen Ostrager
*Assistant Examiner*—Shelley Self
(74) *Attorney, Agent, or Firm*—Young & Thompson

(57) ABSTRACT

Strapping head, comprising three wheels for driving the strap, i.e. an insertion wheel, a recovery wheel and a tensioning wheel, as well as a pressure roller associated with each of the drive wheels, and elements for activating and deactivating the driving of the wheels. According to the invention, the tensioning wheel (6) is made to rotate by a movement cam (7), through an angle of rotation "a" corresponding to an arc with a length equal to the maximum tensioning travelling distance of the strap, and the strap is driven by the tensioning wheel (6) in co-operation with a pressure roller (6*a*) which is displaceable so as to bear with pressure against the strap and the tensioning roller (6), with a predetermined delay with respect to the start of the tensioning roller (6). A single actuating motor operates a single drive belt (C) for driving all the moving parts of the machine.

13 Claims, 4 Drawing Sheets

TENSIONING DEVICE FOR TRAPPING MACHINES

BACKGROUND OF THE INVENTION

The present invention relates to a so-called strapping head to be used in packaging machines and more particularly relates to the strap driving system of the strapping head, which is designed to ensure a high operating speed, albeit using simple means which can be easily maintained and are less costly.

DESCRIPTION OF THE RELATED ART

Some examples of strapping machines are described in the patents IT-B-1,135,722 dated Mar. 24, 1981, EP-C-0, 603,868 dated Nov. 22, 1993—both of which are in the name of the same Applicant—and U.S. Pat. No. 5,379,576 dated Jan. 10, 1995 in the name of STRAPACK Corp., to which reference is made here in order to illustrate the invention more clearly.

As is known, in these strapping machines, strap driving means are provided, said means performing essentially three functions: a) firstly, drawing the strap from a reel and inserting it into a special guide track for guiding it around the product to be packages; b) then, when the strap has travelled around the whole guide track until its front terminal part stops into a first fixing gripper, recovery of the said strap until it is wound around the product to be packages; c) finally, tensioning of the strap, after completion of which the rear terminal part of the strap is likewise blocked by a second clamping gripper.

In addition to said driving means, a strapping head comprises mainly means for joining together, by means of hot clamping one onto the other, the two fixed ends of the strap; after which, cutting of the strap and conveying away of the packaged product are performed.

SUMMARY OF THE INVENTION

The present invention relates to a head intended mainly for tying small parcels, where strapping is performed with a relatively thin strap and the tightening force is obtained by pulling the strap over a predetermined distance. The patent EP-B-0,603,868 refers, on the contrary, to a head in which the tightening force is determined depending on a predefined load which is precisely determined and kept uniform during each strapping operation. This machine was therefor a relatively complex structure; it uses a stronger strap and achieves a high tightening force by means of two drive rollers around which the strap is would over a wide arc.

In the arrangement according to the patent U.S. Pat. No. 5,379,576—which is regarded as being the prior art closest to the invention, on which the preamble of claim 1 is based—three strap drive wheels are provided for driving the strap, i.e., as described more fully below, an insertion wheel and a recovery wheel as well as a tensioning wheel located between the first two. Each of these strap drive wheels co-operates with a respective pressure roller so that the strap is driven only when the pressure roller pushes it against the surface of the respective drive wheel, even if the latter is continuously rotating. In fact, the pressure rollers are each mounted idle on their respective axis and the latter is able to assume two positions, i.e. a working position, where it causes its roller to press the strap against the surface of the respective strap drive wheel, and a rest position, where it positions its roller at a short distance from the respective strap drive wheels, such that the latter is able to rotate freely without driving the strap. Displacement of the pressure roller axes is performed, for example, by means of actuation of corresponding electromagnets.

In the strapping machine according to U.S. Pat. No. 5,379,576, the strap passes firstly between the insertion wheel and the associated pressure roller; it then advances along a first guide track as far as the tensioning wheel; it then passes around the latter, over a wide angular segment; it then passes into a second track guide as far as the recovery wheel; and finally from here, via a third guide track, it advances until it is wound around the product to be packaged. By means of a single actuating motor which is always running, three movement transmission systems, generally consisting of drive belts, ensure driving of, respectively: a) the insertion wheel and the recovery wheel at high-speed; b) a reduction gear, which drives the tensioning wheel at low-speed; and c) a reduction gear which drives a shaft which carries a series of cams for performing the various functions of the machine. Engagement and disengagement means allow switching of the actuation of the different transmissions so as to perform, respectively, insertion and recovery or tensioning or the other functions.

During insertion and recovery operations, said first high-speed movement transmission is active; switching from one operation mode to the other is performed by simply activating the pressure roller associated with the insertion wheel or else the pressure roller associated with the recovery wheel; during the tensioning operation, an electromagnetic clutch engages the second movement transmission with the low-speed reduction gear, with simultaneous activation of the respective pressure roller.

The strapping machine according to U.S. Pat. No. 5,379, 576, however, has various drawbacks: first of all, driving of the tensioning wheel by means of said low-speed transmission, with the associated electromagnetic engagement means, involves a costly constructional design and moreover is subject to incorrect adjustment as a result of wear during use. Moreover, the said use of a second movement transmission is the source of increased costs. Finally, during high-performance operation—where up to 40–50 strapping cycles per minute are performed, as required in modern machines—the start-up and stoppage of an additional movement transmission has an entirely negative effect on the machine cycle time.

The object of the present invention is therefore to provide a strapping machine which has a simpler and less costly structure, but is equally efficient at high working performances and which overcomes the drawbacks mentioned. This object is achieved, in a machine of the type illustrated in U.S. Pat. No. 5,379,576, by means of the characteristic features indicated in claim 1.

Moreover, although the machine according to the invention is based on a tightening action determined on the basis of a predetermined tightening distance, instead of a given tightening load, it allows higher and much more uniform tightening forces to be exerted.

BRIEF DESCRIPTION OF THE DRAWINGS

Further characteristic features and advantages of the invention will emerge more clearly, however, from the following detailed description of a preferred embodiment provided purely by way of a non-limiting example illustrated in the accompanying drawings in which.

DESCRIPTION OF THE PREFERRED EMBODIMENT

Figure 1:
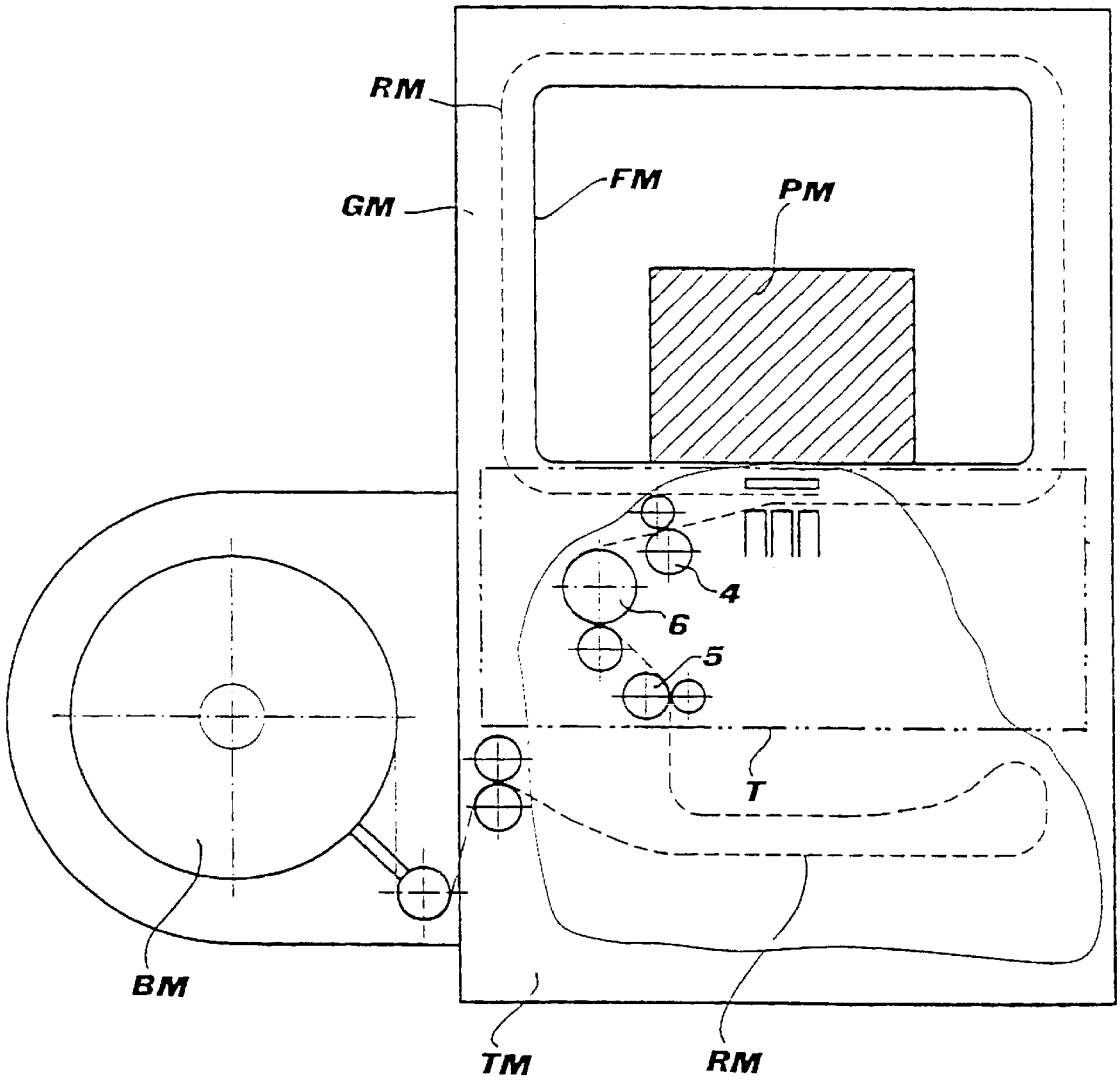
FIG. 1 shows the general diagram of a packaging machine incorporating a strapping head according to the invention.

An example of a packaging machine which uses a strapping head according to the invention is shown in FIG. 1; said head generally comprises a support frame TM, alongside which a reel BM supplying the strap RM is rotatably mounted. The strap is supplied into a temporary store and from here to the drive rollers 5, 6 and 4 of the strapping head T. During start-up, the strap RM is inserted by the wheel 4 into a guide track GM which surrounds a window FM, through which the product PM to be packaged advances; during the subsequent recovery phase, the wheel 5 recovers the strap RM, which is extracted from the guide track GM and closed around the product PM; finally, during the third—tensioning—phase, the wheel 6 tensions the strap as it tightens it firmly around the product PM.

Figure 2:
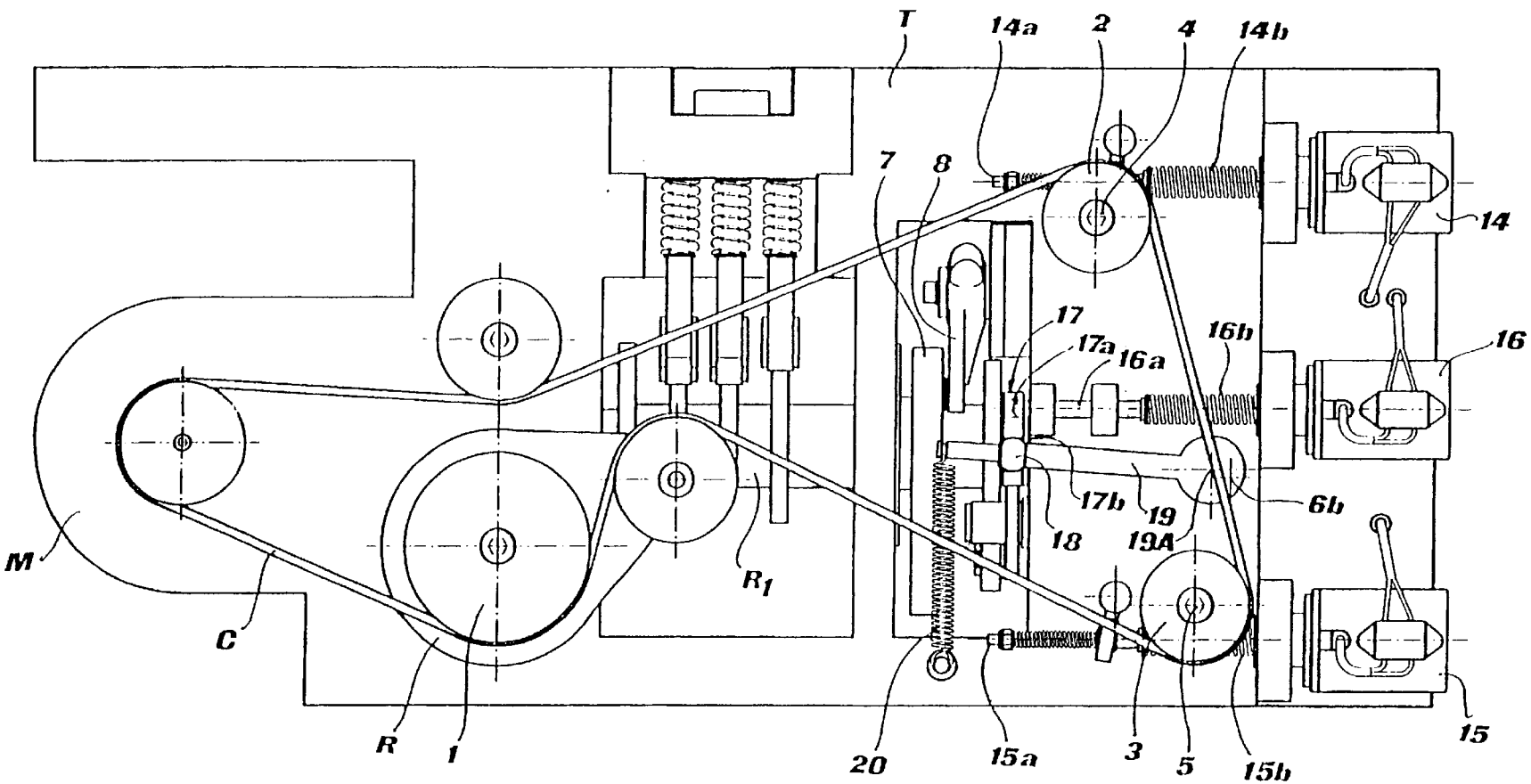
FIG. 2 shows a schematic elevation view of the drive side of the strapping head according to the invention.
Figure 4:
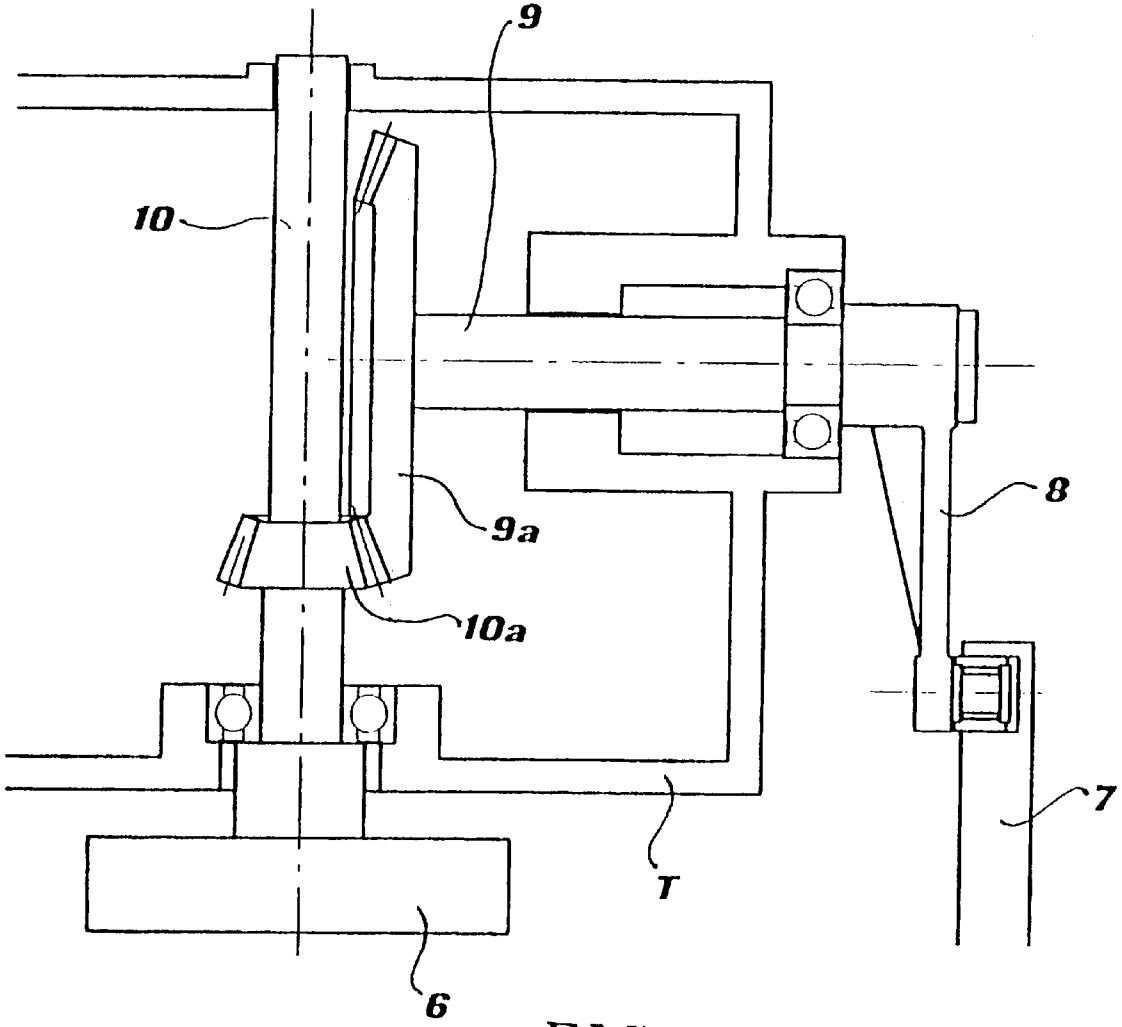
FIG. 4 shows a view of the detail relating to the movement transmission of the drive assembly during final tensioning.

More particularly, and as shown in FIGS. 2 and 4, the strapping head T according to the invention comprises, as regards the part which is relevant for the said invention, a single motor M which operates all the parts of the machine by means of a single drive belt C. This belt C drives, on the one hand, the driving pulley 1 of a reduction gear R which operates the group of actuating cams described further below and, on the other hand, the actuating pulleys 2 and 3 of the insertion wheel 4 and the recovery wheel 5, respectively.

The pulley 1 operates the reduction gear R by means of a clutch, engagement of which is caused—in accordance with a technique known per se—at the same time as disengagement of a device for braking the said reduction gear. The output shaft of this reduction gear has, mounted on it—also in a manner known per se—a series of cams for actuating in sequence, at time intervals defined during the design stage, the various mechanisms of the strapping head. Of these mechanisms, only the mechanism which is of interest for the purposes of the present invention, i.e. that for actuating the tensioning wheel 6, is described; the other mechanisms form substantially part of the prior art and in any case do not concern the present invention.

As shown in FIG. 4, the cam 7—which is one of the cams mounted on the output shaft of the reduction gear R and which, for the purposes of better understanding of the drawing, is shown on the outside of the casing T of the strapping head, instead of inside it—acts on the oscillating arm 8 causing, during the course of its rotation, an oscillation through about 40° of said arm 8 about an axis 9; as illustrated, this axis is parallel to the main longitudinal axis of the casing T and perpendicular to the axis of the motor M and all the other axes or spindles which are rotated by the belt C, in particular also the axis 10 of the tensioning wheel 6. A pair of bevel gears 9*a* and 10*a,* integral with the spindles 9 and 10, transmit the movement from the former to the latter of these spindles with multiplication of the movement in a ratio of 3 to 1; as a result, an oscillation through 40° of the arm 8 is equivalent to rotation of the wheel 6 through an angle of about 120°, in turn equivalent to an arc, on the external diameter of the said wheel 6, having a length of 100 mm. Here and below reference will be made to these angles of 40° and 120° and an arc of 100 mm, although obviously they must be regarded as totally exemplary and able to be defined differently during the design stage.

Figure 3:
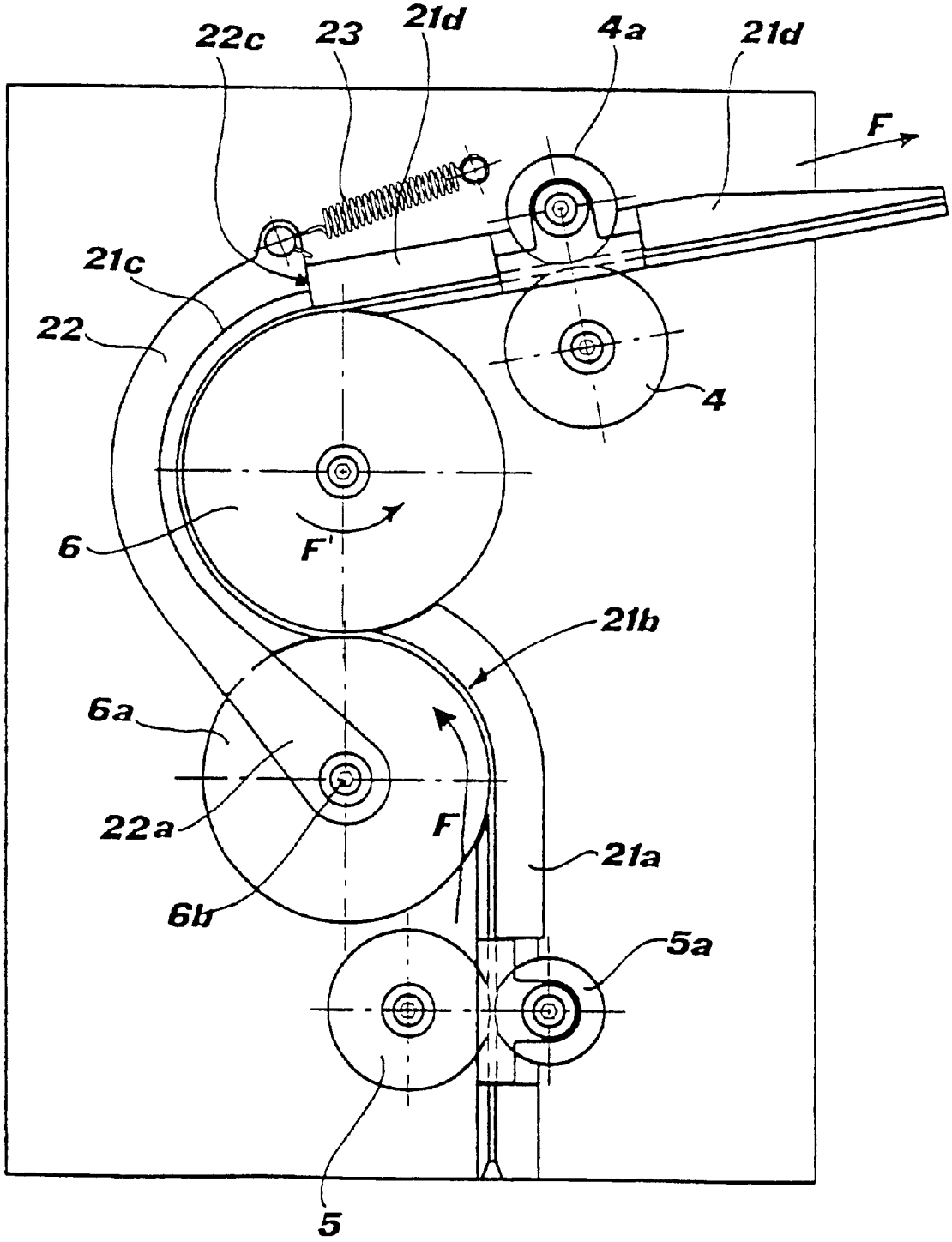
FIG. 3 shows a schematic elevation view of the driving assembly of the strapping head according to the invention, on the opposite side to that shown in FIG. 2.

Pressure rollers 4*a,* 5*a* and 6*a* co-operate with the drive wheels 4, 5 and 6 (see FIG. 3). As already said, these rollers are each able to assume two positions, respectively: a rest position, at a short distance from the respective drive wheel, and a working position, where they rest on the respective drive wheel, pressing the strap, located in between, against the latter. Only in this second working position of the pressure rollers is the strap driven by the respective wheel, while in the rest position, the drive wheel is able to rotate freely without actually causing driving of the said strap. This arrangement of the movable pressure rollers and their manner of co-operating with the wheels, in order to cause driving of the strap, are entirely known and therefore will not be described in greater detail below.

It is important to note, on the other hand—since it forms a characterizing element of the invention—the manner in which the movement of the pressure rollers is performed. For this purpose, in fact, a set of three electromagnets 14, 15 and 16 is used, one for each of the pressure rollers 4*a,* 5*a* and 6*a,* respectively. The electromagnets 14, 15 and 16 are positioned, in accordance with a characteristic feature of the invention, at one end of the casing T of the strapping head, as clearly shown in FIG. 2, so that maintenance and any replacement thereof can be carried out as easily as possible.

The electromagnet 16, when actuated, exerts a pulling action on the rod 16*a,* which is moved against the resistance of the recall spring 10*a;* this movement of the rod 16*a* causes the movement of the pressure roller 6*a* from the rest position into the working position, as follows. The free end of the rod 16*a* engages in a notch 17*a* formed in the lever 17 which also has an eyelet 17*b* inside which a spherical bush 18 is engaged. The rod 19 is engaged inside this bush and is integral at one end with the spindle 6*b* of the pressure roller 6*a,* while at the other end it has, engaged in it, a recall spring 20 which tends to cause the rod 19 to rotate in an anti-clockwise direction, with respect to FIG. 2, about the associated axis 19A. This axis is integral, but eccentric, with respect to the axis 6*b* of the pressure roller 6*a* so that an oscillation of the lever 19 (as stated, in an anti-clockwise direction with respect to FIG. 2) causes an upward displacement of the axis 6*b,* corresponding to the displacement of the roller 6*b* resting on the tensioning wheel 6.

The two electromagnets 14 and 15 operate in a similar manner, or in any case in a manner known from the prior art. The magnet 14, when actuated, exerts a pulling action on the rod 14*a,* which moves against the resistance of the recall spring 14*b;* this movement of the rod 14*a* causes the movement of the pressure roller 4*a* from the rest position into the working position. The electromagnet 15 acts on the roller 5*a,* also by means of a rod 15*a* and spring 15*b.*

The strap guiding path is defined by the following:

- a first straight section 21*a,* along which the pair of insertion wheel 5 and roller 5*a* operates and which terminates in the vicinity of the pressure roller 6*a;*
- a second curved section 21*b,* which is defined between a fixed curved guide and the opposed surface of the pressure roller 6*a* which operates only in order to define the guiding path in this position;
- a third curved section 21*c,* defined between the surface of the tensioning wheel 6 and the opposed guiding surface of the movable segment 22;
- a fourth straight section 21*d,* along which the pair of recovery wheel 4 and roller 4*a* operates and which terminates at the inlet into the guide (not shown) of the arc of the strapping machine (also not shown);

preferably, the pressure rollers 4*a* and 5*a* move towards and away from the respective drive wheels 4 and 5 together with a part of the respective guide 21*d* and 21*a,* so as to ensure guiding of the strap which is as precise as possible, avoiding any risk of jamming.

The movable segment 22 is extended by an arm 22*a* which is mounted freely rotatably on the axis of rotation 6*b* of the roller 6*a;* a tensile spring 23 pushes the segment 22 towards the wheel 6, so that it bears with its flat end 22*c* against the flat end of the fixed guide 21*d.* This bearing point defines the minimum aperture of the guide path around the roller 6.

This arrangement of the segment 22 therefore allows, as can be understood, not only spring-mounting of the said segment about the pin 6*b,* but also a heightwise displacement of this segment, with sliding of its flat end 22*c* against the flat end of the guide 21*d,* so as to follow the movements of the pressure roller 6*a* towards or away from the tensioning wheel 6. This spring-mounted arrangement of the segment 22, forming one of the characteristic features of the present invention, offers a dual advantage: on the one hand, it is able to yield resiliently under the thrusting force of the strap, in particular in the case of sudden stressing of the latter, thereby reducing as far as possible the risk of jamming and, on the other hand, allows complete opening of the guide within the segment 21*c*—after release of the spring 23 and rotation about the axis 6*b*—so that the operations of maintenance and/or freeing of the strap may be performed in the event of severe jamming.

The mode of operation of the strapping head described above comprises the following stages which, moreover, are known per se:

insertion stage: a start signal excites the electromagnet 15 which causes the pressure roller 5*a* to bear against the insertion wheel 5, while the rollers 4*a* and 6*a* remain at a distance from the respective wheels 4 and 6. The front end of the strap is introduced into the guide 21*a* until it is engaged between the pair of wheel 5 and roller 5*a* which feed it forwards (arrow F) and push it inside the straight guide 21*a,* causing it to travel over the arc 21*b,* in the free space formed between the latter and the opposing surface of the roller 6*a,* then inside the free space formed between the latter and the opposing surface of the wheel 6, and then over the arc 21*c* of the segment 22, between the latter and the said wheel 6, and finally inside the straight guide 21*d,* passing through the free space between the pair of wheel 4 and roller 4*a,* towards the strapping machine. As is obvious, this starting phase occurs automatically (automatic loading), without any action other than the introduction of the front end of the strap between the pair of wheel 5 and roller 5*a.* The strap advances until its front end reaches the first clamping gripper in the strapping machine, which closes and clamps this end. This closing movement triggers a signal which starts the recovery phase;

recovery phase: said signal causes excitation of the electromagnet 14; the pressure roller 4*a* bears against the recovery wheel 4, while the rollers 5*a* and 6*a* remain at a distance from the respective wheels 5 and 6. The pair of wheel 4 and roller 4*a* pulls the strap backwards until the latter is closed around the product to be packaged; this closing movement is detected by a special sensor which produces, in a known manner, a signal for starting the next phase involving tensioning of the said strap;

tensioning phase: said starting signal causes activation of the clutch of the wheel 1 and therefore initial rotation of the cam 7 which starts to rotate the tensioning wheel 6 in an anti-clockwise direction (arrow F'). The same signal causes—at the same instant, or else with a predetermined delay—excitation of the electromagnet 16 which, freeing the plate 17, allows the pressure roller 6*a* to bear against the wheel 6, therefore pressing the strap against this wheel 6. The delay which can be adjusted upon excitation of the electromagnet 16 may be produced by means of a simple timer—easily accessible to the operator performing adjustment—located in the electric circuit supplying the start-up signal to the said electromagnet 16. Thus, tensioning of the strap may start immediately when rotation of the wheel 6 starts, or with a delay of between 0 and n tenths of a second, where "n" represents a time less than the time taken by the tensioning wheel 6 to perform the whole of its travel movement through 120°; depending on the delay chosen for activation of the pressure roller 6*a,* the strap will therefore be driven by an amount corresponding to the whole recovery travelling distance of the tensioning wheel (zero delay; 100 mm travel, as stated above) or by an amount corresponding to only a part of this travelling distance. In other words, the greater the delay "n" with which the pressure roller 6*a* intervenes, with respect to the moment when the travel movement of the tensioning wheel 6 starts, the smaller will be actual driving movement of the strap on the roller 6 and therefore the smaller will be the tensioning force applied to the product to be packaged.

As is obvious from above, the movement of the tensioning wheel 6 forms part of the movement of the cam shaft which performs, in a known manner, the different operations associated with the entire machine cycle; therefore, after the clutch of the pulley 1 has been engaged, the machine is able to complete the entire cycle without further interruptions, i.e. it offers the advantage of not introducing idle time due to stoppage and restarting.

The profile of the cam 7, which causes oscillation of the arm 8 or rotation of the tensioning wheel 6, is determined so that, at the end of said oscillation through 40°, and therefore at the maximum tensioning point, it maintains for a certain period of time the arm 8 in this position; this time is used for clamping of the second gripper, which causes fixing of the rear end of the strap.

When this fixing operation has been completed, a special cam—again moved by the main shaft R1 of the reduction gear R—causes the backwards movement of the lever 17, against the action of the spring 20, until the rod 16*a* engages in the notch 17*a;* in this way, the pressure of the roller 6*a* on the wheel 6 is eased. The blade for cutting the strap is able to act as soon as the pressure of the roller 6*a* has been eased, i.e. after the tension of the said strap has been slackened, so as to avoid, in a known manner, the undesirable effect of fraying of the cut end. At the same time, the cam 7 is able to bring the arm 8, and consequently the tensioning wheel 6 also, back into their initial rest position.

It is understood, however, that the invention is not to be regarded as limited to the particular embodiment illustrated above which constitutes only a non-limiting example of the scope of the said invention, but that different variants are possible, all within the competence of a person skilled in the art, without departing from the scope of protection of the invention, as defined by the claims which follow.

What is claimed is:

1. Strapping machine, comprising:

three wheels for driving a strap, said three wheels rotatably mounted on said machine, said three wheels comprising an insertion wheel, a recovery wheel and a tensioning wheel, a movement cam operatively connected to said tensioning wheel, said tensioning wheel made to rotate by said movement cam, three pressure rollers, one pressure roller adjacent each of said three drive wheels, each of said three pressure rollers being displaceable from a rest position in which the respective drive roller is inoperative, to a working position, in which the respective drive roller is bearing by pressure onto the strap and onto the respective drive wheel thereby to perform a drive function, means to adjust the length of the working travel of said tensioning wheel, wherein, said tensioning wheel (6) is made to rotate by the movement cam (7) through a substantially constant angle of rotation "a", corresponding to an arc having a length equal to the maximum tensioning traveling distance of the strap, and said means to adjust the length of the working travel of the tensioning wheel includes means to bring the respective pressure roller into cooperation with the tensioning wheel with a predetermined delay in respect of the starting moment of the rotation "a" of the tensioning wheel.

2. Strapping machine according to claim 1, in which said movement cam of the tensioning wheel (6) is integral with a shaft (R1) carrying all the cams for activation of the machine functions.

3. Strapping machine according to claim 1, further comprising a single actuating motor which operates a single drive belt (C) for driving all the moving parts of the machine.

4. Strapping machine according to claim 3, in which said single drive belt (C) drives a pulley (1) which can be engaged with and disengaged from a speed-reducing unit (R) which operates said shaft (R1) carrying the cams for activation of the machine functions.

5. Strapping machine according to claim 4, in which said shaft (R1) actuates said cam (7) operating the tensioning wheel (6).

6. Strapping machine according to claim 1, in which each of said pressure rollers (4*a*, 5*a*, 6*a*) is displaceable from said rest position into said working position under the thrust of a pressure spring after release of stopping means.

7. Strapping machine according to claim 6, in which said stopping means comprise, on the one hand, a lever (17) provided with a stopping notch (17*a*) and, on the other hand, a rod (16*a*) which can be actuated by an electromagnet (16) and the end of which engages in said stopping notch.

8. Strapping machine according to claim 1, in which the strap is driven, respectively, by said insertion wheel (5) and by said recovery wheel (4) in cooperation with respective pressure rollers (5*a* and 4*a*), each of which is displaceable from a rest position into a working position, so as to bear with pressure against the strap and the corresponding drive wheel.

9. Strapping machine according to claim 8, in which the displacement of said pressure rollers (5*a* and 4*a*) is effected by respective actuating electromagnets (15, 14).

10. Strapping machine according to claim 9, in which said electromagnets (14, 15, 16) are arranged in a position which is accessible, at one end of a casing of the strapping machine.

11. Strapping machine according to claim 1, wherein only said insertion wheel is operative during insertion of the strap and said recovery wheel and said tensioning wheel are inoperative during insertion of the strap.

12. Strapping machine, comprising:

three wheels rotatably mounted on said machine and driving a strap, said three wheels comprising an insertion wheel for inserting the strap during a start-up phase, a recovery wheel for recovering the strap during a recovery phase, and a tensioning wheel for tensioning the strap around a product during a tensioning phase;

a movement cam operatively connected to said tensioning wheel, said tensioning wheel made to rotate by said movement cam;

a pressure roller adjacent each of said three drive wheels, each of said three pressure rollers being displaceable from i) a rest position where the respective drive roller is inoperative, to ii) a working position where the respective drive roller is pressure bearing onto the strap and onto the respective drive wheel to perform a drive function; and means to adjust the length of the working travel of said tensioning wheel, wherein, said tensioning wheel rotates by the movement cam through a substantially constant angle of rotation corresponding to an arc having a length equal to the maximum tensioning traveling distance of the strap, and said means to adjust the length of the working travel of the tensioning wheel includes means to bring the respective pressure roller into cooperation with the tensioning wheel with a predetermined delay in respect of the starting moment of the angle of rotation of the tensioning wheel.

13. Strapping machine, comprising:

three wheels rotatably mounted on said machine and driving a strap, said three wheels comprising an insertion wheel for inserting the strap during a start-up phase, a recovery wheel for recovering the strap during a recovery phase, and a tensioning wheel for tensioning the strap around a product during a tensioning phase;

a pressure roller adjacent each of said three drive wheels, each of said three pressure rollers being displaceable from i) a rest position where the respective drive roller is inoperative, to ii) a working position where the respective drive roller is pressure bearing onto the strap and onto the respective drive wheel to perform a drive function;

means to adjust the length of the working travel of said tensioning wheel;

a movement cam operatively connected to said tensioning wheel, said tensioning wheel made to rotate by said movement cam through a substantially constant angle of rotation corresponding to an arc having a length equal to the maximum tensioning traveling distance of the strap; and said means to adjust the length of the working travel of the tensioning wheel includes means to bring the respective pressure roller into cooperation with the tensioning wheel with a predetermined delay in respect of the starting moment of the angle of rotation of the tensioning wheel.

* * * * *